US006694972B2

(12) United States Patent
Hetzel, Jr.

(10) Patent No.: US 6,694,972 B2
(45) Date of Patent: Feb. 24, 2004

(54) GAS CANISTER PROTECTION SYSTEM

(75) Inventor: John M. Hetzel, Jr., Dayton, OH (US)

(73) Assignee: Government Specialty Products, Dayton, OH (US)

( * ) Notice: Subject to any disclaimer, the term of this patent is extended or adjusted under 35 U.S.C. 154(b) by 117 days.

(21) Appl. No.: 09/977,416

(22) Filed: Oct. 15, 2001

(65) Prior Publication Data

US 2002/0069873 A1 Jun. 13, 2002

Related U.S. Application Data

(60) Provisional application No. 60/240,234, filed on Oct. 13, 2000.

(51) Int. Cl.[7] ..... A62B 17/04

(52) U.S. Cl. ..... 128/201.22; 128/201.29; 128/202.24; 128/202.27

(58) Field of Search ..... 128/201.24, 201.29, 128/202.19, 202.24, 202.27, 206.14, 207.11, 201.22; 2/424, 5, 84

(56) References Cited

U.S. PATENT DOCUMENTS

| | | | | | |
|---|---|---|---|---|---|
| 3,911,913 | A | * | 10/1975 | June | 128/201.29 |
| 4,184,212 | A | * | 1/1980 | Bowman | 2/5 |
| 4,602,385 | A | * | 7/1986 | Warren | 2/2.14 |
| 5,027,810 | A | * | 7/1991 | Patureau et al. | 128/206.24 |
| 5,188,267 | A | | 2/1993 | Sargent et al. | |
| 5,274,850 | A | | 1/1994 | Aldridge | |
| 5,309,571 | A | * | 5/1994 | Huang | 2/458 |
| 5,517,691 | A | | 5/1996 | Blake | |
| 5,555,569 | A | | 9/1996 | Lane | |
| 6,006,360 | A | * | 12/1999 | Reed | 2/202 |
| 6,260,207 | B1 | * | 7/2001 | Barbeau et al. | 2/202 |
| 6,266,828 | B1 | * | 7/2001 | Corsini | 2/424 |
| 6,338,340 | B1 | * | 1/2002 | Finch et al. | 128/205.27 |
| 6,478,025 | B1 | * | 11/2002 | Yort et al. | 128/201.25 |
| 6,510,850 | B1 | * | 1/2003 | Izuchukwu et al. | 128/202.19 |

* cited by examiner

*Primary Examiner*—Weilun Lo
*Assistant Examiner*—Michael Mendoza
(74) *Attorney, Agent, or Firm*—Thompson Hine LLP

(57) ABSTRACT

A protective neck and shoulder shroud assembly for use with a self contained breathing apparatus, the assembly including a neck curtain including a head portion, a left flap coupled to and extending generally forwardly from the head portion, and a right flap coupled to and extending generally forwardly from the head portion. The neck curtain further includes a fastener for releasably coupling the left and right flaps together such that when the flaps are coupled together. The neck curtain has a front opening located above the flaps, the front opening being located to expose at least a portion of a wearer's face or to expose at least a portion of an mask worn on the wearer's face when the neck curtain is worn by a wearer. The assembly includes a generally cylindrical enclosure shaped and sized to receive a gas canister therein, and a fastener for coupling the enclosure to an inner surface of the neck curtain.

35 Claims, 4 Drawing Sheets

GAS CANISTER PROTECTION SYSTEM

This application claims priority to U.S. Provisional Application Serial No. 60/240,234, filed Oct. 13, 2000, the contents of which are hereby incorporated by reference.

BACKGROUND OF THE INVENTION

The present invention is directed to a firefighting or other hazardous duty headgear assembly for use with a protective helmet and self contained breathing apparatus.

In firefighting and other hazardous duty industries, workers are often required to enter and work in hostile environments. In many of these hostile environments, the ambient gases are not safe for breathing, and therefore the worker must carry along a source of fresh air, such as a SCBA (self contained breathing apparatus). Firefighters and other workers must also typically wear heavy and bulky protective gear. Accordingly, there is a need for a system that can carry and protect gas canisters that can be easily worn and is relatively unobtrusive.

SUMMARY OF THE INVENTION

The present invention is a system that can carry and protect gas canisters, that can be easily worn and is unobtrusive. In one embodiment, the invention includes a neck curtain that is removably attachable to a firefighting helmet. The neck curtain includes a head portion adapted to surround the back and sides of the wearer's head and neck, a left flap extending forward from the head portion, a right flap extending forward from the head portion, a fastener for fastening the left and right flaps together in front of the wearer's neck and face, and a front opening above the left and right flaps adapted to expose a portion of a wearer's face or to expose a portion of a SCBA mask worn on the wearer's face. The invention also includes a substantially cylindrical enclosure sized for receiving an SCBA gas canister therein and a fastener for coupling the cylindrical enclosure to an inner surface of the head portion of the neck curtain.

The cylindrical enclosure may be constructed from a high heat and flame resistant fabric material (such as an aramid material, a polybenzamidazole material, an aramid blend material, a polybenzamidazole blend material or a combination of aramid and polybenzamidazole materials), the outer surface of which may be coated with or bonded to a heat reflective material (such as an aluminized coating).

The fastener for coupling the cylindrical enclosure to an inner surface of the neck curtain is preferably positioned so that the cylindrical enclosure is substantially or completely covered by the neck curtain when the neck curtain is worn by a wearer along with a firefighting helmet and associated SCBA system. The materials of the cylindrical enclosure preferably reflect heat away from the gas canister contained therein so that the system can be worn in high heat situations, such as during ARFF (Aircraft Rescue and Firefighting) operations where the temperatures can reach 3500 to 4000° F.

The fastener for coupling the cylindrical enclosure to the inner surface of the neck curtain is preferably positioned such that the cylindrical enclosure is maintained inside the neck curtain, thus allowing the neck curtain to provide an additional heat barrier between the ambient heat and the gas canister.

The neck curtain is preferably constructed from multiple layers of fabric material that include an outer layer of heat and flame resistant fabric material, a moisture barrier layer located adjacent the outer layer, and a facecloth layer and/or thermal barrier located adjacent the moisture barrier. Preferably, the outer layer of heat and flame resistant material is also coated with a heat reflective material, such as an aluminized coating.

The cylindrical enclosure may have an axial length that is approximately equal to the combined length of the gas canister and the SCBA hose extending between the gas canister and the mask. In this case the cylindrical enclosure can provide a heat barrier between the ambient environment and temperature and the hose extending between the gas canister and the mask.

In another aspect of the present invention a protective enclosure is provided to protect a gas canister from high ambient heat. Such an invention may include a substantially cylindrical enclosure constructed from heat and flame resistant fabric material and sized to closely receive a gas canister therein. The cylindrical enclosure may include an outermost layer or coating of a heat reflective material, such as an aluminized material. The heat and flame resistant material may be an aramid material, a polybenzamidazole material, an aramid blend, a polybenzamidazole blend material or a combination of an aramid and/or polybenzamidazole material.

The cylindrical enclosure may have an axial length approximating the combined length of the gas canister and the hose extending between the gas canister and the mask, and the cylindrical enclosure may also include an opening at a longitudinal end thereof for receiving the gas canister therein.

The cylindrical enclosure may also include a generally axially extending slit running from the longitudinal end thereof to an axial point along the cylindrical enclosure proximate to where the interface between the gas canister and the hose will be positioned when the gas canister is received within the cylindrical enclosure. The slit forms a pair of flap-like sections in the cylindrical enclosure. The cylinder enclosure may include a fastener for releasably coupling the pair of flap-like sections together around the hose when the gas canister is received within the cylindrical enclosure.

The fastener for coupling the pair of flap-like sections together may include a first fastener component extending from an inner surface of a first one of the flap-like sections proximate the slit, and a second fastener component, adapted to mate with the first fastener component, and extending from an outer surface of the other one of the flap-like sections, distal from the slit. In this manner, the fastener can releasably couple the pair of flap-like sections together around the hose to constrict the cylindrical enclosure about the hose and thereby securely retain the hose therein.

The cylindrical enclosure may include at least one hole extending through the longitudinal end of the cylinder enclosure opposite to that end of the cylindrical enclosure having the opening for receiving the gas canister therein. The holes at the bottom of the cylindrical enclosure allow air intake which may be necessary for proper operation of the SCBA system.

Other objects and advantages of the present invention will be apparent from the following description and the accompanying drawings.

DETAILED DESCRIPTION

Figure 1:
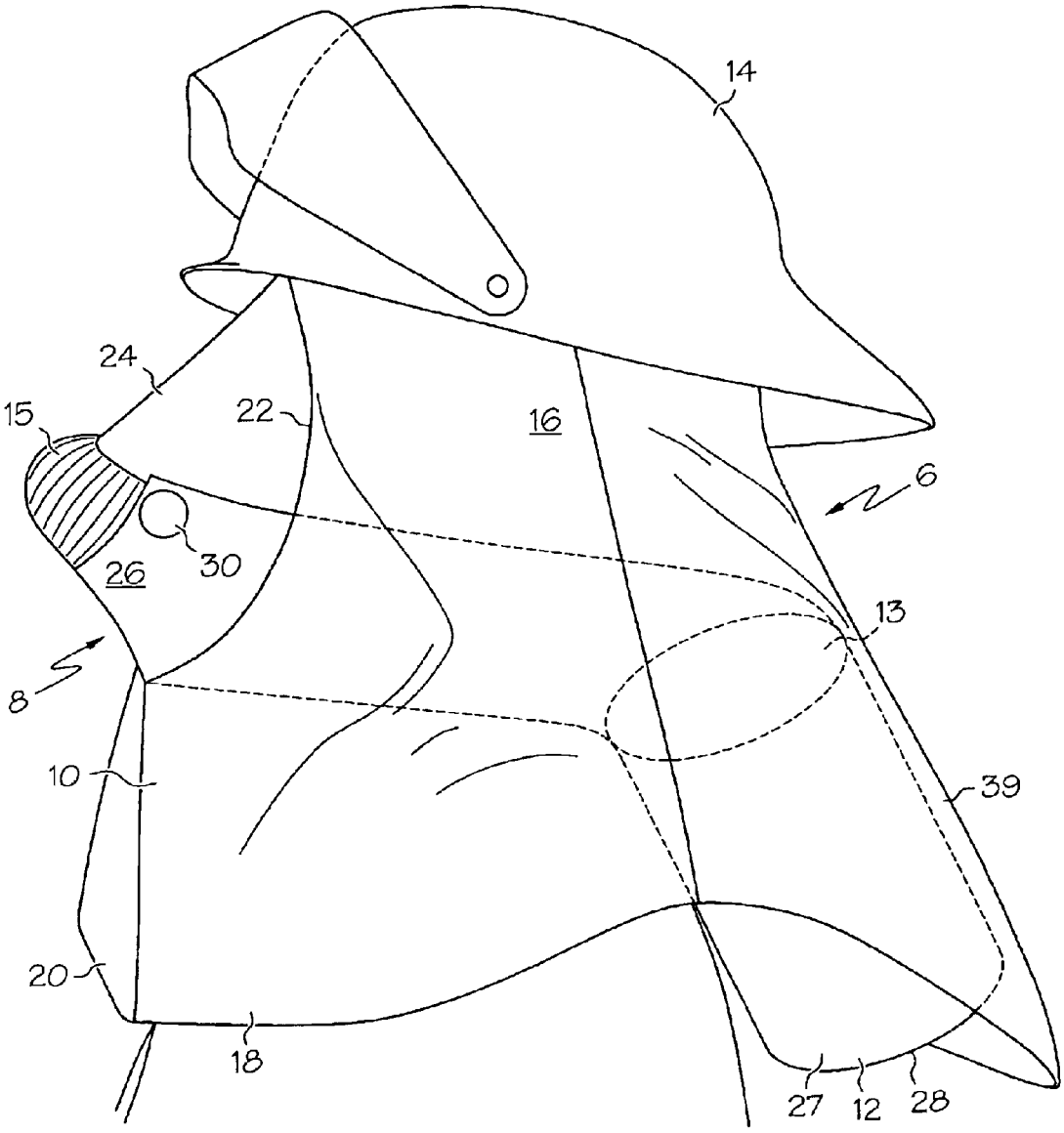
FIG. 1 is a side view of one embodiment of the protective shroud assembly of the present invention, mounted to a firefighter's helmet.

As shown in FIG. 1, the protective shroud assembly and SCBA gas canister protection system of the present invention, generally designated 6, can be used with a SCBA system, generally designated 8. The SCBA system 8 may include a generally cylindrical SCBA gas canister 13 (shown in phantom in FIG. 1), which supplies a source of breathable air, a SCBA facemask 24 (shown in solid lines in FIG. 1) designed to fit over the face of a wearer, and a SCBA tube 15 (the end of which is shown in solid lines in FIG. 1) for delivering air from the gas canister 13 to the facemask 24. The tube 15 is coupled to the mask 24 and to a top end of the canister 13 (connection not shown in FIG. 1). In one embodiment, the canister 13 is about 5.3" by about 2.7", the tube 15 has about a 1 inch diameter and is about 8 inches long.

The system 6 of the present invention includes two primary components: a shroud or neck curtain 10 and a substantially cylindrical enclosure 12. The neck curtain 10 is adapted to be removably coupled within a firefighting helmet 14 substantially about the inner perimeter of the firefighting helmet by various attachment means, such as snaps, clasps, bracelets, etc. The neck curtain 10 includes a head portion 16 shaped and adapted to generally surround the sides and back of a wearer's head and neck when the neck curtain 10 is coupled to the helmet 14 and the helmet and neck curtain 10 are then located on a wearer's head. The head portion 16 includes a rear flap portion 39 shaped and located to cover the upper back and back of the shoulders of the wearer.

Figure 4:
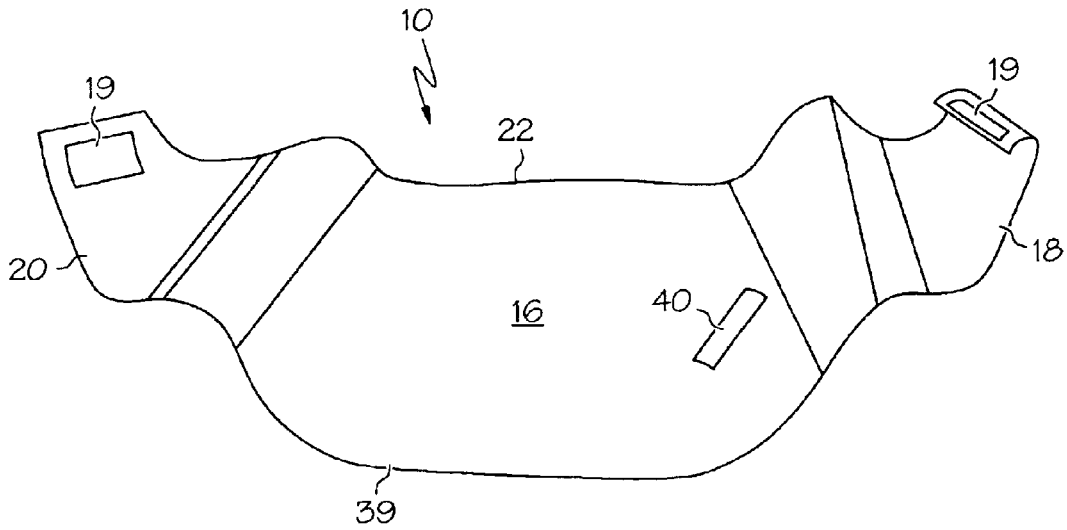
FIG. 4 is a top view of the neck curtain of the protective shroud assembly of FIG. 1, with the neck curtain being laid flat.

The neck curtain 10 preferably includes a pair of front flap portions 18, 20, each of which extend generally forwardly from the head portion 16 and are adapted to be releasably attached to each other in front of the wearer's face and/or neck. For example, as shown in FIG. 4, each flap portion 18, 20 may include a patch 19 of a hook and loop fastener that can be releasably joined together. In this manner, when the flap portions 18, 20 are joined, the neck curtain 10 completely surrounds the wearer's neck and most of the wearer's head, while leaving a front opening 22 in front of the wearer's face. The front opening 22 is also shaped and located to expose the mask 24 worn by the wearer. In an alternate embodiment, the neck curtain could be part of a hood that is worn over the wearer's head.

The neck curtain 10 is preferably a multi-layered fabric component having an outer shell layer of aluminized PBI (polybenzamidazole) material and a moisture barrier layer located adjacent to the outer shell. The moisture barrier layer may include a semi-permeable membrane layer that is moisture vapor permeable but impermeable to liquid moisture, such as expanded polytetrafluoroethylene fibers, or various moisture barrier layers marketed under the trademarks GORETEX, AQUATEK or Southern Mills COMFORT ZONE. The neck curtain 10 may also include an innermost facecloth and/or thermal liner, such as a quilted E-89 liner located adjacent to the moisture barrier layer. In the exemplary embodiment, the materials for the various layers of the neck curtain 10 are selected so that the neck curtain satisfies the CFR 1976 Standard.

The enclosure 12 is preferably sized to receive the gas canister 13 therein. The enclosure 12 is also sized to receive at least the majority of the hose 15 therein such that an upper end of the hose 15 can protrude outwardly from the enclosure 12 and be coupled to the mask 24. The enclosure 12 is preferably constructed from a heat reflective material, such as an aluminized PBI material. The enclosure 12 includes an open end 26 which is sized and located to receive the hose 15 therethrough, and a closed end 28 sized and located to abut against the bottom of the gas canister 13. The closed end 28 preferably includes at least one, and preferably a plurality, of holes 36 formed therein to provide air access to a gas canister 13 located in the enclosure 12.

Figure 2:
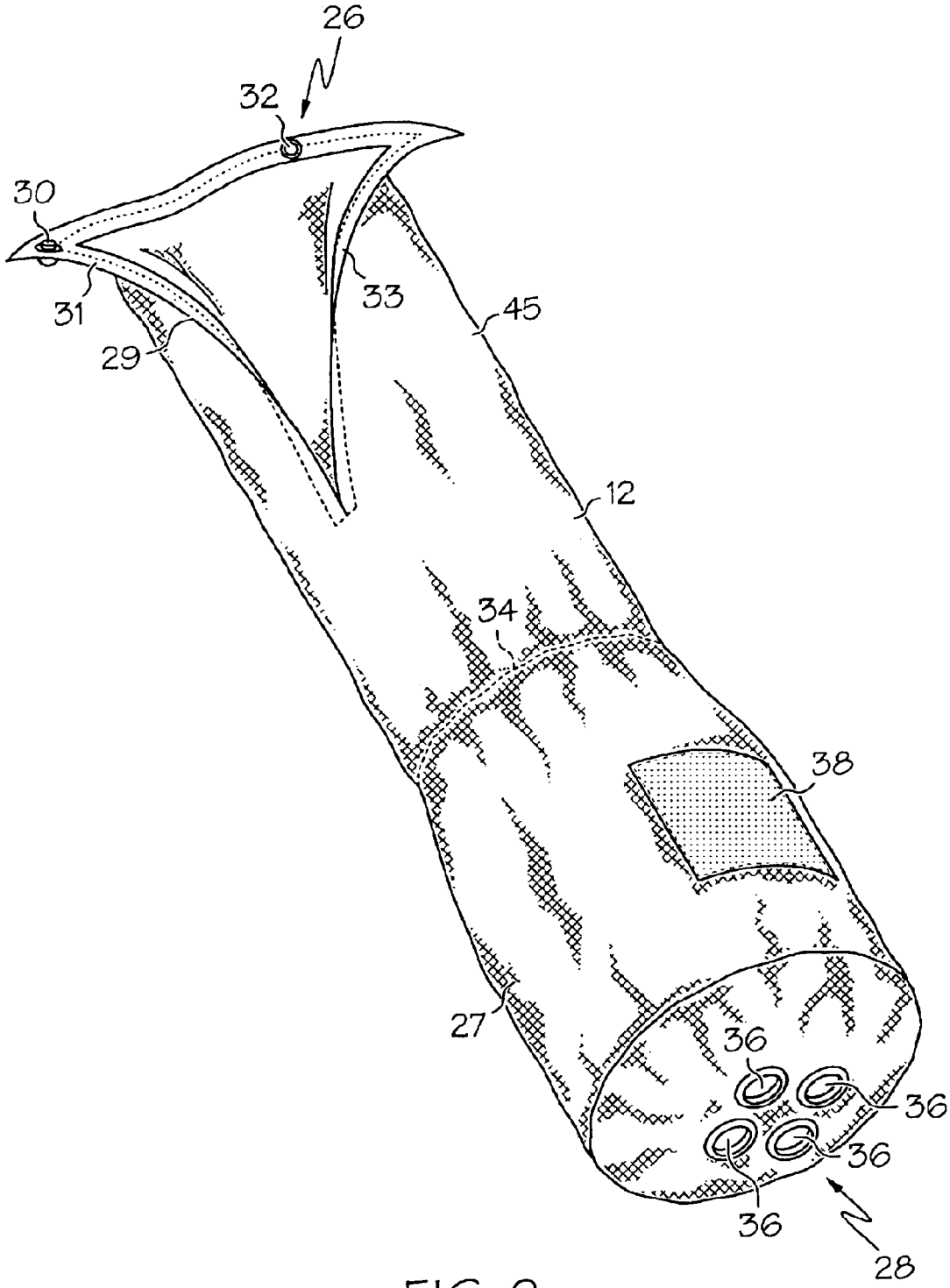
FIG. 2 is a front perspective view of the enclosure of the shroud assembly of FIG. 1, with the flaps of the enclosure in their open position.
Figure 3:
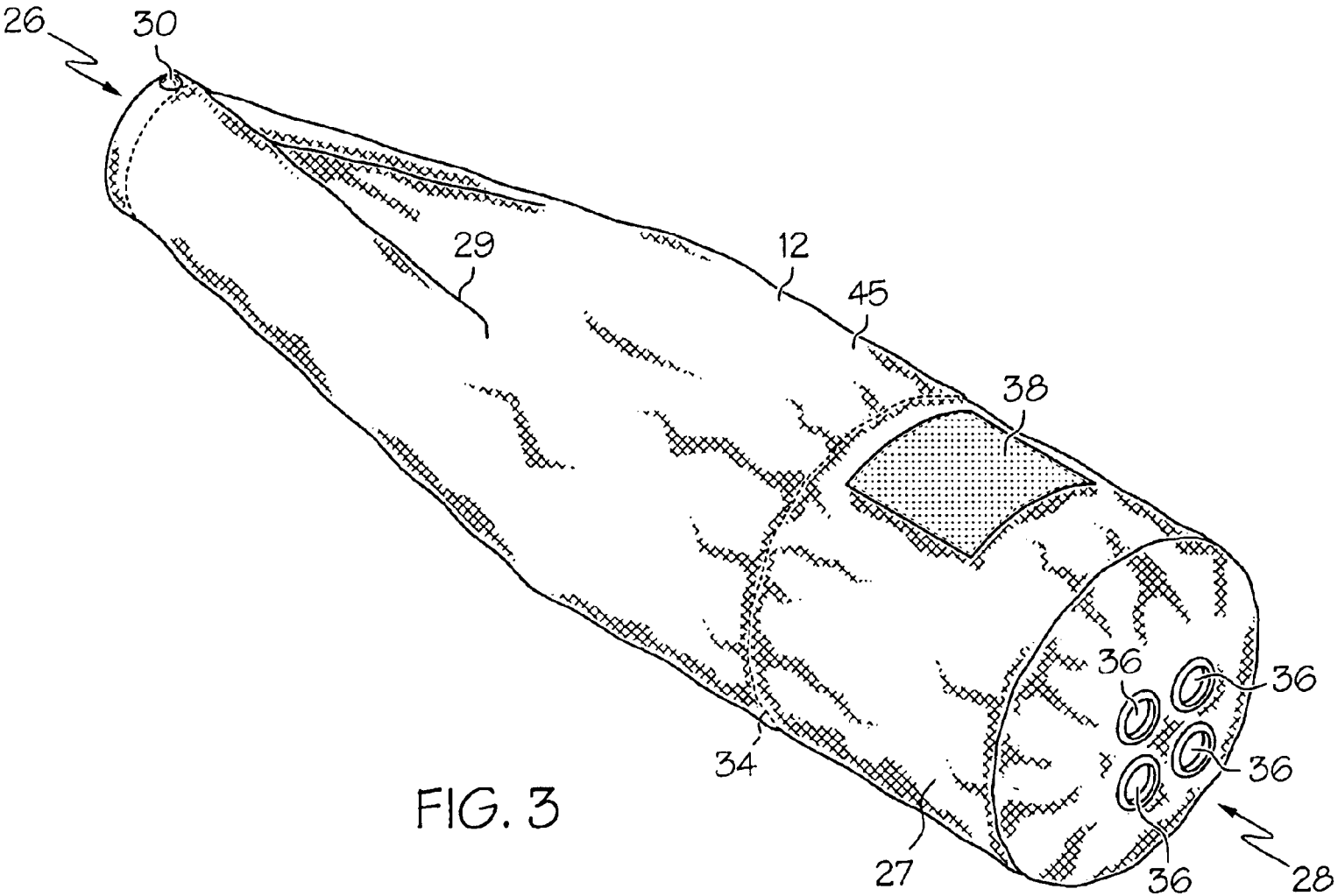
FIG. 3 is a rear perspective view of the enclosure of the shroud assembly of FIG. 1, with the flaps of the enclosure in their closed position.

As shown in FIGS. 2 and 3, the enclosure 12 includes a generally axially extending slit 29 extending from the open end 26 to a point proximate to where the where the hose 15 interfaces with the associated gas canister 13. The slit 29 of the enclosure 12 essentially forms a pair of flaps 31, 33. The enclosure 12 includes a first fastener component, such as a male snap component 30, located on or extending from an outer surface of a first one of the flaps 31 and proximate to the slit 29. The enclosure 12 further includes a second fastener component, such as a female snap component 32, located on from an inner surface of the other one of the flaps 33, and laterally spaced from the slit 29. Both snap components 30, 32 are preferably located adjacent the open end 26 of the enclosure 12. The snaps 30, 32 can be joined together to releasably couple the flaps, 31, 33 together in a partially overlapping manner (see FIG. 3). The snaps 30, 32 are located such that the enclosure is tightly closed around the hose 15 to constrict the enclosure 12 about the hose 15 such that the hose 15 is gripped and held in place at the open end 26. Of course, various other structures for coupling the flaps 31, 33 together may be used without departing from the scope of the invention, such as hook-and-loop fasteners (such as VELCRO), clasps, brackets, hooks, magnets and other attachment mechanisms.

The enclosure 12 may include a strip of elastic material 34 is sewn about the perimeter of the cylindrical enclosure 12. The strip of elastic material 34 is spaced apart from the open 26 and closed 28 ends of the enclosure 12. The elastic material 34 defines the upper edge of a canister-receiving portion 27 that is shaped and sized to closely receive the gas canister 13 therein, and defines the lower edge of a tube portion 45 that is shaped and sized to at least partially receive the tube 15 therein. The elastic material 34 preferably extends at least partially around the perimeter of the enclosure 12 and somewhat constricts the enclosure 12 about the upper end of a gas canister 13 located therein to maintain the gas canister 13 in a stable position in the enclosure 12.

Figure 5:
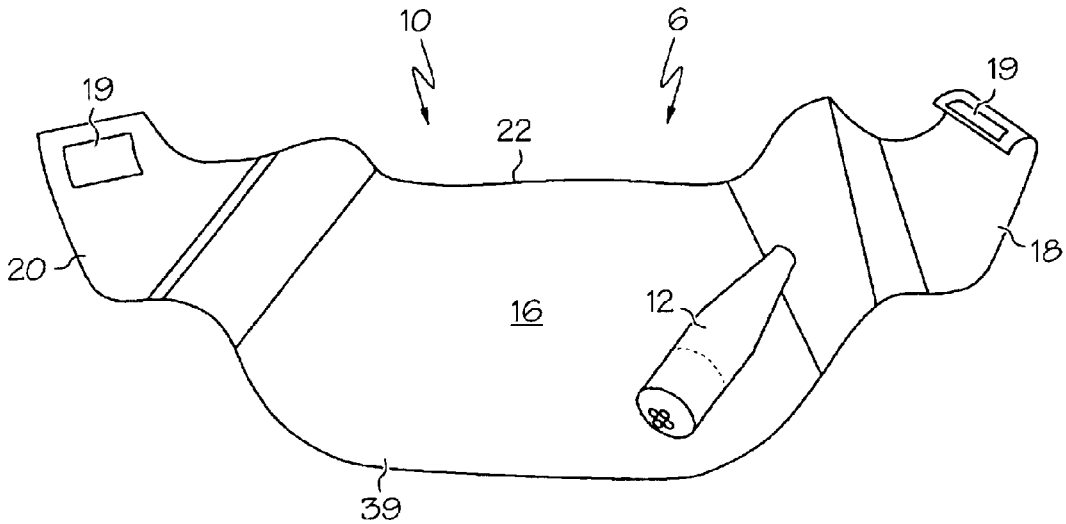
FIG. 5 is a top view of the neck curtain of FIG. 4, with the enclosure of FIGS. 2 and 3 attached thereto.

The enclosure 12 may include a patch 38 of hook-and-loop fastener material (such as VELCRO) located on an outer surface thereof. The neck curtain 10 includes a corresponding patch 40 of hook-and-loop fastener material on an inner surface thereof (see FIG. 4). The patches 38, 40 can cooperate to releasably attach the enclosure 12 to the inner surface of the neck curtain 10 (see FIG. 5). As shown in FIG. 4, the patch 40 of hook-and-loop fastener material on the inner surface of the neck curtain 10 is preferably longitudinally shaped and adapted to run substantially parallel to a wearer's shoulders so that the cylindrical enclosure 12 can be located at any location along the patch 40. This enables the neck curtain 10 to accommodate wearers having both broad and narrow shoulders. Of course, various other methods for attaching the enclosure 12 to the neck curtain 10 may be used without departing from the scope of the invention such as snaps, clasps, brackets, hooks, magnets and other attachment mechanisms.

As shown in FIG. 1, when the gas canister 13 and tube 15 are mounted inside the enclosure 12, and the enclosure 12 is coupled to the neck curtain 10, the enclosure 12, gas canister 13 and tube 15 are located generally below the neck curtain 10, and on, or adjacent to, a shoulder of the wearer. The patches 38, 40 are preferably positioned such that a gas canister 13 enclosed within the enclosure 12 will be completely or almost completely covered by the neck curtain 10. In this manner, the neck curtain 10 provides a protective barrier between the gas canister 13 and the ambient environment, and further protects the gas canister 13 from becoming overheated. The rear flap portion 39 of the neck curtain 10 may need to be lengthened as compared to the length of the flap portion 39 of conventional neck curtains 10 to ensure that the neck curtain 10 substantially covers the cylindrical enclosure 12 and associated gas canister 13. Furthermore, because the enclosure 12 and canister 13 are located on the shoulder of the wearer, the wearer can easily carry the weight of the canister 13 on his or her shoulder, and the canister 13 is located in an unobtrusive position.

Having described the invention in detail and by reference to the preferred embodiments, it will be apparent that modifications and variations thereof are possible without departing from the scope of the invention.

What is claimed is:

1. A protective neck and shoulder shroud assembly for use with a self contained breathing apparatus, the assembly comprising:

(a) a neck curtain, including, a head portion, a left flap coupled to and extending generally forwardly from said head portion, a right flap coupled to and extending generally forwardly from said head portion, and a fastener for releasably coupling said left and right flaps together such that when said flaps are coupled together said neck curtain has a front opening located above said flaps, said front opening being located to expose at least a portion of a wearer's face or to expose at least a portion of an mask worn on said wearer's face when said neck curtain is worn by a wearer;

(b) a generally cylindrical enclosure shaped and sized to receive a gas canister therein; and (c) a fastener for coupling said enclosure to an inner surface of said neck curtain.

2. The assembly of claim 1 wherein said neck curtain includes an outer layer of heat and flame resistant fabric material and a moisture barrier layer.

3. The assembly of claim 2 wherein said enclosure includes a layer of a heat and flame resistant fabric material.

4. The assembly of claim 3 wherein:

said outer layer of heat and flame resistant material of said neck curtain is coated with or attached to an outermost layer of heat reflective material; and said heat and flame resistant fabric material of said cylindrical enclosure is coated with or attached to an outermost layer of heat reflective material.

5. The assembly of claim 4 wherein both of said outermost layers are an aluminized coating.

6. The assembly of claim 5 wherein said layers of heat and flame resistant material are taken from a group consisting of an aramid material, a polybenzamidazole material, an aramid blend material, a polybenzamidazole blend material, and a combination of aramid and polybenzamidazole materials.

7. The assembly of claim 2 wherein said cylindrical enclosure includes an open end and a tube receiving portion extending axially from said open end, said tube receiving portion being adapted to receive a hose of an SCBA system therein.

8. The assembly of claim 1 wherein:

said cylindrical enclosure has an axial length, said axial length being approximate equal to the combined length of a SCBA gas canister and a SCBA hose coupled to said SCBA gas canister, and wherein said cylindrical enclosure includes an open end for receiving said SCBA gas canister therethrough.

9. The assembly of claim 1 wherein said cylindrical enclosure further includes a generally axially extending slit intersecting a longitudinal end thereof and forming a pair of flap-like sections, and a fastener for releasably coupling said pair of flap-like sections together.

10. The assembly of claim 9 wherein said fastener includes a first fastener component extending from an inner surface of a first one of said flap-like sections, and a second fastener component, adapted to mate with said first fastener component, extending from an outer surface of the other one of the flap-like sections, wherein said first and second fastener components can be joined together such that said first and second flaps at least partially overlap.

11. The assembly of claim 10 wherein one of said fastener components is located adjacent to said slit, and the other of said fasteners components is spaced away from said slit.

12. The assembly of claim 1 wherein said cylindrical enclosure is made primarily of a heat and flame resistant fabric material.

13. The assembly of claim 12 wherein said heat and flame resistant fabric material of said cylindrical enclosure is coated with or attached to an outermost layer of heat reflective material.

14. The assembly of claim 13 wherein said outermost layer is an aluminized coating.

15. The assembly of claim 14 wherein said layer of heat and flame resistant material is taken from a group consisting of an aramid material, a polybenzamidazole material, an aramid blend material, a polybenzamidazole blend material, and a combination of aramid and polybenzamidazole materials.

16. The assembly of claim 1 wherein said cylindrical enclosure includes a closed end having at least one hole extending therethrough.

17. The assembly of claim 1 said fastener is a releasable fastener.

18. The assembly of claim 17 wherein said releasable fastener includes a first fastener element located on an outer surface of said cylindrical enclosure and a second fastener element located on an inner surface of said neck curtain, and wherein said first and second fastener elements are positioned such that said enclosure is substantially covered by said neck curtain when said first and second fastener elements are fastened together.

19. The assembly of claim 18 wherein said first fastener element is a first strip of hook-and-loop material and wherein said second fastener element is a second strip of hook-and-loop material, and wherein said second strip of hook-and-loop material is a longitudinal strip adapted to run substantially parallel to a wearer's shoulders when said neck curtain is worn by a wearer.

20. The assembly of claim 1 wherein said enclosure includes a strip of elastic material attached to said enclosure and extending at least partially around the perimeter of said enclosure, said strip of elastic material dividing said enclosure into a canister-receiving portion that is sized to closely receive a SCBA canister therein, and a hose-receiving portion that is sized to closely receive a SCBA hose therein.

21. A protective enclosure for protecting an SCBA gas canister, the enclosure comprising a substantially cylindrical enclosure is made primarily of a heat and flame resistant fabric material and sized to closely receive an SCBA gas canister therein and including a fastener component for releasably fastening said enclosure to an inner surface of a firefighting garment.

22. The protective enclosure of claim 21 wherein said enclosure includes an outermost layer or coating of heat reflective material.

23. The protective enclosure of claim 21 wherein said heat reflective material is an aluminized material.

24. The protective enclosure of claim 21 wherein said heat and flame resistant material is taken from a group consisting of an aramid material, a polybenzamidazole material, an aramid blend material, a polybenzamidazole blend material, and a combination of aramid and polybenzamidazole materials.

25. The protective enclosure of claim 21, wherein said cylindrical enclosure includes a closed end and an open end sized to receive said SCBA gas canister therethrough.

26. The protective enclosure of claim 25 wherein said cylindrical enclosure further includes a generally axially extending slit intersecting said open end and forming a pair of flap-like sections, and a fastener for releasably coupling said pair of flap-like sections together.

27. The protective enclosure of claim 26 wherein said fastener includes a first fastener component extending from an inner surface of a first one of said flap-like sections, and a second fastener component, adapted to mate with said first fastener component, extending from an outer surface of the other one of the flap-like sections, wherein said first and second fastener components can be joined together such that said first and second flaps at least partially overlap.

28. The protective enclosure of claim 27 wherein one of said fastener components is located adjacent to said slit, and the other of said fasteners components is spaced away from said slit.

29. The protective enclosure of claim 21 wherein said fastener component is a strip of a hook and loop fastening material.

30. The protective enclosure of claim 21 wherein said enclosure includes a strip of elastic material attached to said enclosure and extending at least partially around the perimeter of said enclosure, said strip of material dividing said enclosure into a canister-receiving portion that is sized to closely receive a SCBA canister therein, and a hose-receiving portion that is sized to closely receive a SCBA hose therein.

31. A protective enclosure for receiving a SCBA canister therein and for being attached to a neck curtain comprising:

generally cylindrical body portion having a closed end an open end, said body portion including a canister receiving portion shaped and sized to closely receive an SCBA canister therein and a generally cylindrical tube receiving portion shaped and sized to receive an SCBA tube therein, said cylindrical body portion being made primarily of a heat and flame resistant fabric material and having a slit located adjacent to said open end, said slit forming a pair of flap-like portions that can be removably coupled together in an at least partially overlapping manner, said body portion further including a strip of elastic material located between said canister receiving portion and said tube receiving portion; and a fastening component coupled to said body portion for releasably attaching said body portion to a neck curtain.

32. A method for mounting a SCBA gas canister to a protective enclosure comprising the steps of:

providing an enclosure including a generally cylindrical body portion having a closed end and an open end, said cylindrical body portion being made primarily of a heat and flame resistant fabric material;

passing a SCBA gas canister through said open end;

providing a neck curtain that is shaped to fit onto a wearer;

releasably attaching said enclosure to said neck curtain; and placing said neck curtain on said wearer.

33. The method of claim 32 further comprising the step of coupling said neck curtain to a helmet after said attaching step.

34. A protective enclosure for protecting an SCBA gas canister, the enclosure comprising a substantially cylindrical enclosure made primarily of a heat and flame resistant fabric material and sized to closely receive an SCBA gas canister therein, said enclosure being adapted to be releasably coupled to the inner surface of a firefighter garment, wherein said cylindrical enclosure includes a closed end and an open end sized to receive said SCBA gas canister theretbrough, and wherein said cylindrical enclosure further includes a generally axially extending slit intersecting said open end and forming a pair of flap-like sections, and a fastener for releasably coupling said pair of flap-like sections together.

35. The protective enclosure of claim 34 further comprising a fastener component for releasably fastening said enclosure to an inner surface of a firefighting garment.

* * * * *